US006886488B2

(12) United States Patent
Berthiaume et al.

(10) Patent No.: US 6,886,488 B2
(45) Date of Patent: May 3, 2005

(54) WAKEBOARD PULLING APPARATUS

(75) Inventors: Yves Berthiaume, Mont St-Hilaire (CA); John T. Huberty, Palm Bay, FL (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/634,912

(22) Filed: Aug. 6, 2003

(65) Prior Publication Data

US 2004/0025774 A1 Feb. 12, 2004

Related U.S. Application Data

(60) Provisional application No. 60/401,014, filed on Aug. 6, 2002.

(51) Int. Cl.[7] ..... B63B 21/04
(52) U.S. Cl. ..... 114/253
(58) Field of Search ..... 114/253

(56) References Cited

U.S. PATENT DOCUMENTS

| | | | | | |
|---|---|---|---|---|---|
| 4,213,413 | A | * | 7/1980 | Courtney | 114/253 |
| 4,893,577 | A | * | 1/1990 | Jennings | 114/253 |
| 5,406,904 | A | * | 4/1995 | Kobayashi | 114/363 |
| 2001/0006037 | A1 | * | 7/2001 | Badley | 114/253 |

* cited by examiner

*Primary Examiner*—Stephen Avila
(74) *Attorney, Agent, or Firm*—BRP Legal Services

(57) ABSTRACT

A watercraft includes a towing bar that allows the tow line connection point to move with respect to the watercraft. This movement of the point of force application reduces moments created on the watercraft resulting in pitch, yaw, and roll. The towing bar can be formed as an inverted V-shape. The towing bar can also be formed as a flexible beam that bends in the lateral direction of the object being towed. The watercraft may also include a pylon that can be moved between an operative position and a stowed position. The pylon is selectively supported on one of two longitudinally and vertically displaced mounts and at an upper lateral support member formed by the grab handle.

29 Claims, 5 Drawing Sheets

WAKEBOARD PULLING APPARATUS

CROSS-REFERENCE TO RELATED APPLICATIONS

This application claims priority to U.S. Provisional Application No. 60/401,014 filed Aug. 6, 2002. The entirety of that application is incorporated herein by reference.

BACKGROUND OF THE INVENTION

1. Field of the Invention

This invention relates to jet powered watercraft, especially personal watercraft ("PWC"). In particular, the invention is directed to a towing apparatus for a PWC.

2. Description of Related Art

Conventional pulling apparatus on watercraft consists of tow eye hooks extending from the deck or hull or pylons that extend upwardly from the deck. Typical pylons are rigid poles, some of which extend by telescoping. Pylons are often supported by guy lines or poles from the deck so that the upstanding pylon does not pull out of its mooring during use. Pylons can be single poles or can be formed as towers or roll cages.

FIGS. 7 and 8 illustrate examples of these prior art pulling apparatuses. Each figure shows the rear of a watercraft 310 having a hull 312 and a deck 314. A steering nozzle 316 extends from the jet propulsion system as is conventionally known through the rear of the hull 312. A pedestal 318 extends from the deck 314 and supports a seat 320 and a grab handle 322. Behind the seat 320 and pedestal 318 is a reboarding platform 324 formed in the deck 314, which provides a space onto which a person in the water may climb onto the watercraft 310. As shown in FIG. 7, one apparatus for attaching a tow line to a watercraft 310 is a tow eye hook 326. And as shown in FIG. 8, another apparatus is a telescoping pylon 328, having a spool 330 at the top and a joint 332 for collapsing the telescoping pylon 328 near the middle of the pylon.

When pulling or towing an object with a watercraft, the watercraft can experience a force from the object that causes the watercraft to move. There are three different types of movements typically experienced by a watercraft: yaw, roll, and pitch. Yaw describes movement about a vertical axis. Roll means to move from side to side about a longitudinal axis. Pitch describes movement about a lateral axis, as in the bow slanting up or down. For example, a sport boat pulling a water skier can be pulled from side to side when the skier traverses the wake. This lateral movement of the stem of the watercraft, or yaw, can affect the ride of the watercraft.

When a pylon is used to pull an object, the force exerted by the object also affects the watercraft along its longitudinal axis as the force is applied above the hull of the watercraft. So, if a wake boarder, for example, makes a hard side cut, the watercraft can experience a lateral force applied at the top of the pylon where the tow rope is secured. This can cause the watercraft to roll to one side, again affecting the ride.

An object being pulled by a watercraft can also create a downward movement of the stem relative to the bow of the watercraft. This movement, or pitch, can be amplified by the application of the pulling force at the top of the pylon.

The effect of a towed object is more pronounced in lighter watercraft, such as personal watercraft (PWC). In that case, a wake boarder, for example, can exert a large pulling force on a PWC, especially if the wake boarder is engaging in tricks and acrobatic moves, as is currently popular. As understood by those of ordinary skill in watercraft design, towed objects that are moving different directions, especially at high speeds, can have a significant impact on the yaw, roll, and pitch of a vehicle.

Another issue associated with towed objects is the structure used to support the tow rope. In an effort to lift the rope above the surface of the water, upright pylons are commonly used. To adjust the height of the tow rope above the water, telescoping pylons are used. Telescoping pylons are convenient because they retract when not in use. However, the telescoping feature can be problematic due to interference between the telescoping elements, which can cause jamming and affect operation. Also, rust and salt corrosion are common problems in marine environments that can affect the performance of moving parts.

BRIEF SUMMARY OF THE INVENTION

An aspect of embodiments of this invention is to provide a towing apparatus for a watercraft that minimizes the effects of pulling an object behind the watercraft.

Another aspect of embodiments of this invention reduces the effect on roll, pitch and yaw of a watercraft from a towed object.

A further aspect of embodiments of this invention provides a pylon that can be easily and securely stowed when not in use.

The invention is directed to a watercraft comprising a hull having a longitudinal center line and a deck supported by the hull, a propulsion source supported by the hull, and a towing apparatus secured to one of the deck and the hull. The towing apparatus has a towing point from which a tow line extends, and the towing point is movable with respect to the longitudinal center line.

The towing apparatus can comprise a towing bar having two ends and an apex, with each end secured to one of the deck and the hull on opposed sides of the longitudinal center line and the apex being positioned rearwardly of the two ends with respect to hull and generally aligned with the longitudinal center line.

The towing bar can also comprise a flexible towing bar that is formed as an upright member extending upwardly from the deck. Preferably, the upright member is generally wedge shaped having a wider and less flexible portion adjacent the deck.

The invention is also directed to a watercraft comprising a hull and a deck supported by the hull, a propulsion source supported by the hull, a pylon support assembly positioned on the deck including a variable pylon attachment point, and a towing pylon removably secured to the variable attachment point in a first stowed position and in a second operative position.

Preferably, the towing assemblies that embody the invention are provided on a personal watercraft or a watercraft that has a jet propulsion unit.

These and other aspects of the invention will become apparent upon reading the following disclosure in accordance with the Figures.

DETAILED DESCRIPTION OF PREFERRED EMBODIMENTS OF THE INVENTION

The invention is described with reference to a personal watercraft ("PWC") for purposes of illustration only. However, it is to be understood that the towing systems described herein can be utilized in any watercraft, particularly those crafts that are powered by a jet propulsion system, such as sport boats.

Further, the present embodiment describes an apparatus generally used for towing a skier behind the PWC, but one skilled in the art will recognize that the PWC could tow any object using this apparatus. The towed object could be a wakeboard and rider, an inflatable object, another boat, or a person. The towed object also could be an airborne object such as a parasail.

Figure 1:
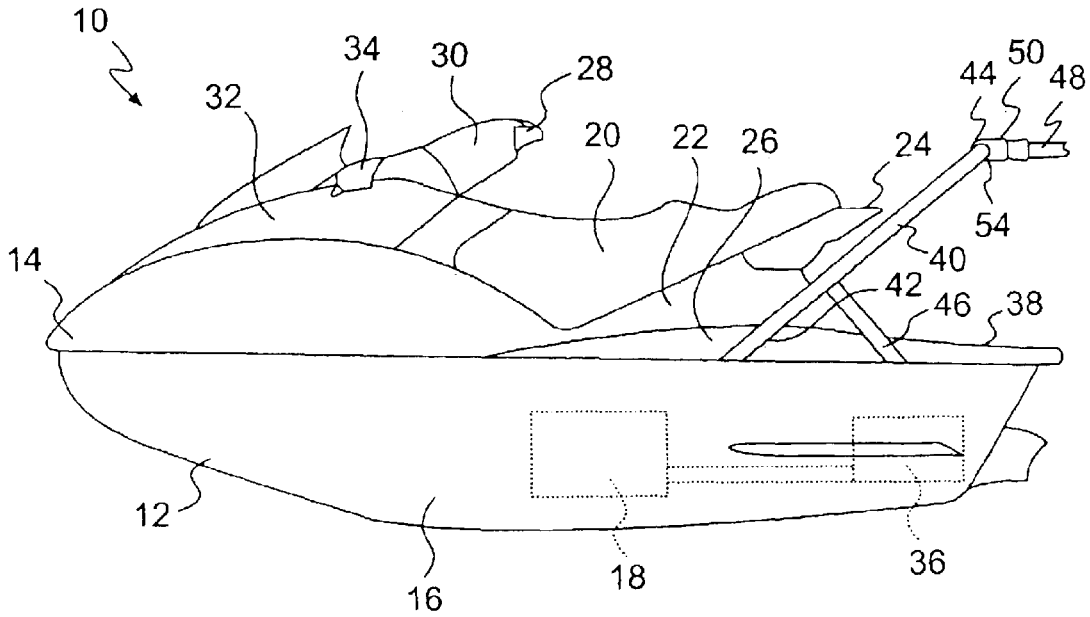
FIG. 1 is a side schematic view of one type of watercraft with a towing assembly in accordance with a preferred embodiment of the invention.

The general construction of a PWC 10 in accordance with a preferred embodiment of this invention is shown in FIG. 1. The following description relates to one way of manufacturing a PWC according to a preferred design. Obviously, those of ordinary skill in the watercraft are will recognize that there are other known ways of manufacturing and designing watercraft and that this invention would encompass other known ways and designs.

The watercraft 10 of FIG. 1 is made of two main parts, a hull 12 and a deck 14 integrally joined together. The hull 12 buoyantly supports the watercraft 10 in the water. The deck 14 is designed to accommodate a rider and, in some watercraft, one or more passengers.

The space between the hull 12 and the deck 14 forms a volume commonly referred to as the engine compartment 16 (shown in phantom). The engine compartment 16 accommodates an engine 18 as well as a muffler, tuning pipe, gas tank, electrical system (battery, electronic control unit, etc.), air box, storage bins, and other elements required or desirable in the watercraft 10. The engine 18 is preferably an internal combustion engine, but an electric motor or other power generation source may be used.

The deck 14 has a centrally positioned straddle-type seat 20 positioned on top of a pedestal 22 to accommodate a rider in a straddling position. The seat 20 may be sized to accommodate a single rider or multiple riders. A grab handle 24 may provided between the pedestal 22 and the rear of the seat 20 to provide a handle onto which a passenger may hold. This arrangement is particularly convenient for a passenger seated facing backwards for spotting a water skier, for example. A pair of walls generally extending upward from the deck 14 and commonly known as gunwales or gunnels 26 provide lateral support for the rider's feet.

Steering handles 28 are located on a helm assembly 30 that is located forward of the seat 20. The helm assembly 30 also contains other devices that allow the rider to operate the watercraft 10. Forward of the helm assembly 30 is a hood 32 that may provide access to a storage compartment. Rearview mirrors 34 are positioned on either side of the hood 32 to allow the rider to see behind.

The watercraft 10 is generally propelled by a jet propulsion system 36 or jet pump, which pressurizes water to create thrust as is known. The propulsion system 36 can be supported in the hull 12 or can be an outboard engine.

A reboarding platform 38 is provided at the rear of the watercraft 10 on the deck 14 to allow the rider or a passenger to easily reboard the watercraft 10 from the water. Carpeting or some other suitable covering may cover the reboarding platform 38. A retractable ladder (not shown) may be affixed to the rear of the deck 14 to facilitate boarding the watercraft 10 from the water onto the reboarding platform 38.

Figure 2:
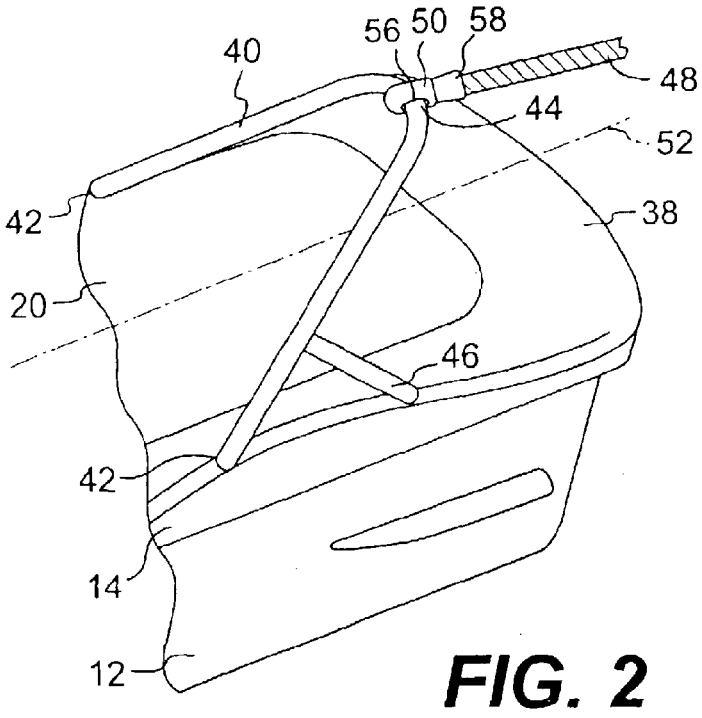
FIG. 2 is a partial perspective view of the rear of the watercraft of FIG. 1.

As best seen in FIGS. 1 and 2, in one embodiment of the invention, the watercraft 10 further comprises a towing apparatus in the form of a towing bar 40 having two ends 42 and an apex 44. The towing bar 40 is supported on either side by braces 46 that connect to the towing bar 40 and one of the hull 12 or the deck 14. The towing bar 40 can be formed of a bent rigid pipe. The towing bar 40 is preferably fixed to the deck 14 or to the watercraft frame or internal support structure to provide a secure mount. It is also possible to provide a mounting structure on the deck 14 or hull 12 that allows the towing bar 40 to be removably secured to the mounting structure.

A tow line 48 is connected to the towing bar 40 by a slidable connector 50. The slidable connector 50 allows the tow line 48 to move along the length of the towing bar 40, both laterally with respect to a longitudinal axis 52 of the watercraft 10 and vertically with respect to a horizontal reference line, such as the waterline. The slidable connector 50 is preferably a sleeve 56 with a tow rope fastener 58 such as a clamp. The fastener 58 can be formed integral with the tow rope 48. Alternatively, the sleeve 56 can be a hook or other type of grommet secured to the end of a tow line 48. It is also possible to simply tie or loop the tow line 48 to the towing bar 40.

Figure 3C:
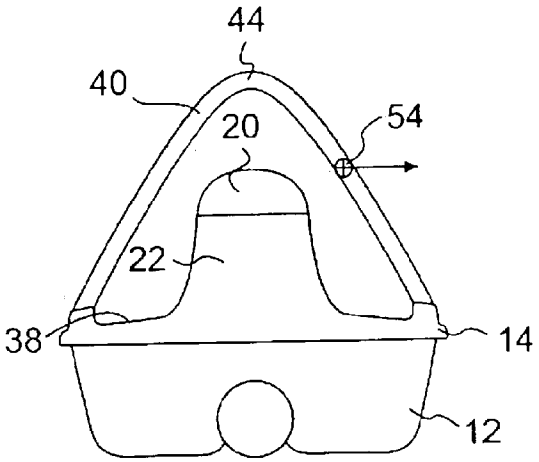
FIGS. 3A through 3C are schematic views of the rear of the watercraft of FIG. 1 that demonstrate the points of force application when the object being towed is in various positions relative to the watercraft.
Figure 3B:
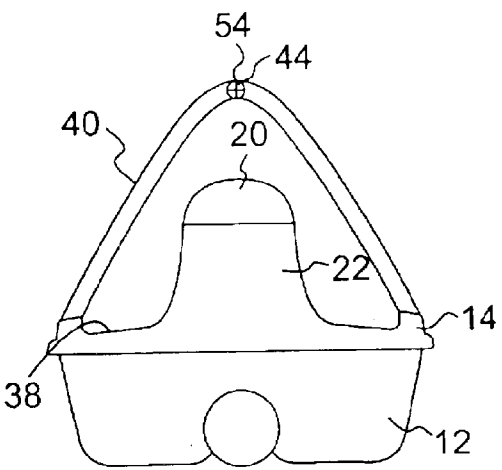
Figure 3A:
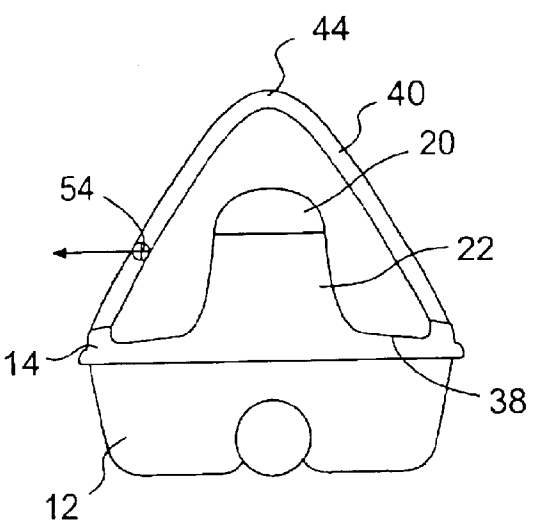

The towing point 54 is the point at which the slidable connector 50 is positioned along the towing bar 40 while the tow line 48 is in use. As best seen in FIGS. 3A through 3C, the towing point 54 moves along the arc of the towing bar 40 as the object being towed moves laterally with respect to the longitudinal axis 52 of the watercraft 10. As a result of the shape of the towing bar 40 in the present embodiment, the towing point 54 moves both vertically and horizontally, thereby reducing the effect of roll on the watercraft 10.

In the present embodiment, the towing bar 40 is generally V-shaped with a rounded apex 44, but one skilled in the art will recognize that a bar of any shape may be used, as long as the towing point 54 is movable with respect to a longitudinal axis 52 of the watercraft. The apex 44 represents the highest point with respect to the deck 14 and the most rearward point. For example, the towing bar 40 could be generally U-shaped. Although the present embodiment contemplates both horizontal and vertical change of position of the towing point 54 as it travels along the towing bar 40, vertical change of position is not essential to the invention. Therefore, the towing bar 40 could be substantially linear and disposed horizontally and perpendicular to the longitudinal axis 52 of the watercraft 10. The towing bar also could be generally U-shaped or generally V-shaped but positioned on the watercraft 10 such that the apex 44 is the most rearward point but is the same height as the rest of the towing bar 40. Then, as the slidable connector 50 moves along the towing bar 40, the towing point 54 would not change vertical position. It is also contemplated that the towing bar 40 could formed of a pliable or resilient material so that a pulling force will temporarily distort the towing bar 40 to diminish the effect of the force.

Figure 4A:
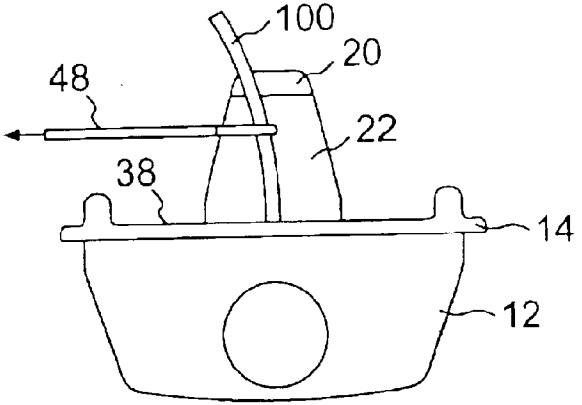
FIGS. 4A through 4B are schematic views of the rear of the watercraft of FIG. 4 that demonstrate the manner of operation of the apparatus of FIG. 4 when the object being towed is displaced laterally relative to the watercraft.
Figure 4B:
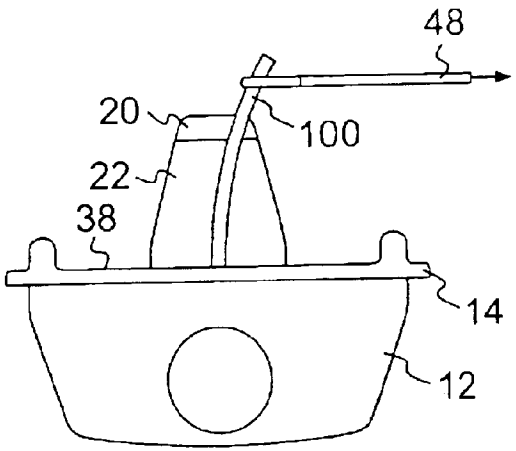
Figure 4:
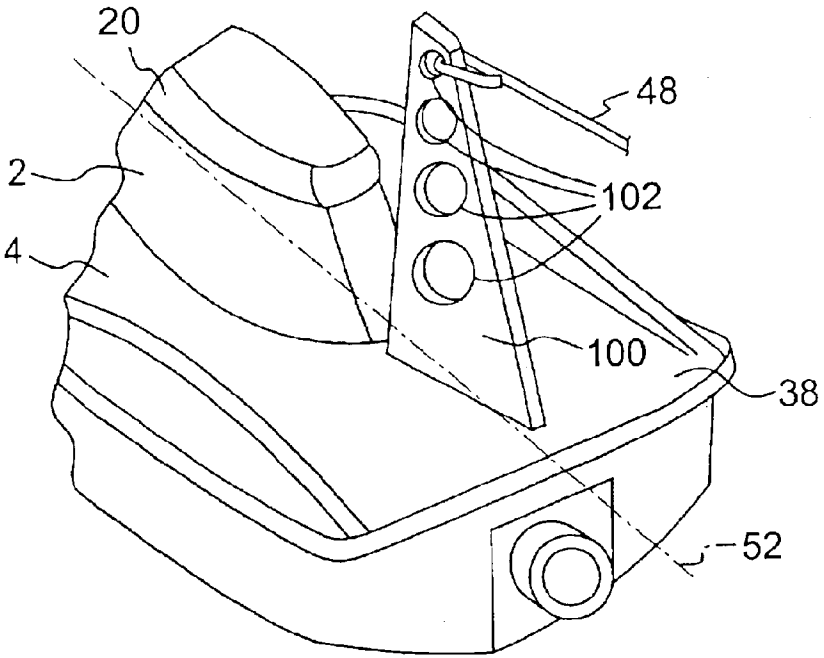
FIG. 4 illustrates a partial perspective rear view of one type of watercraft with a towing assembly in accordance with a second preferred embodiment of the invention.

As seen in FIG. 4, in accordance with another embodiment of the invention, a flexible towing bar 100 is provided on the reboarding platform 38 with a plurality of apertures 102 through which the tow line 48 is looped. The towing bar 100 is supported by and mounted or joined to the deck 14 at the reboarding platform 38. The towing bar 100 can be bolted or otherwise securely fastened onto the deck 14 or mounted in a receptacle formed in the deck 14. Preferably, the towing bar 100 is formed as an upright beam positioned at the longitudinal axis 52 of the watercraft. The towing bar 100 is formed of a flexible material, such as plastics, fiberglass, or composites.

The towing bar 100 may take the form of a trapezoid, as shown, or of any other shape capable of accommodating at least one aperture 102 or tow rope connecting mechanism. The towing bar 100 is preferably constructed such that its cross sectional area where it contacts the reboarding platform 38 is greater than that at its top, or unsecured, end. This change of cross sectional area causes the lower portion of the towing bar 100 to be less flexible than the upper portion. The change of cross sectional area can occur gradually throughout the height of the of the towing bar 100, or it can occur abruptly at one or several distances from the reboarding platform 38.

While this embodiment discloses a towing bar 100 with four apertures 102 through which the tow line 48 is attached, one skilled in the art will recognize that any number of apertures 102 can be provided. Further, apertures are not the only possible means of connecting the tow line 48 to the towing bar 100. The present invention could comprise a flexible towing bar without apertures, but with at least one fastening mechanism, such as a hook or a groove.

As shown in FIG. 4A, the tow line 48 can be looped through an aperture 102 near the middle of the towing bar 100. When the object being towed moves laterally with respect to the longitudinal axis 52, the tow line 48 causes the flexible towing bar 100 to bend or flex in the lateral direction of the object being towed. And as shown in FIG. 4B, the tow line 48 can be looped through an aperture 102 near the top of the towing bar 100 to offer more flexibility.

Figure 5A:
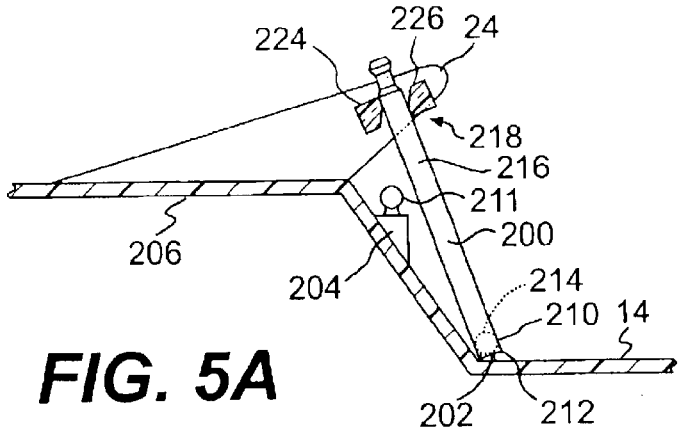
FIG. 5A is a partial cross-section of the deck and reboarding platform of one type of watercraft with a towing assembly in accordance with a third preferred embodiment of the invention in the stowed position.
Figure 5B:
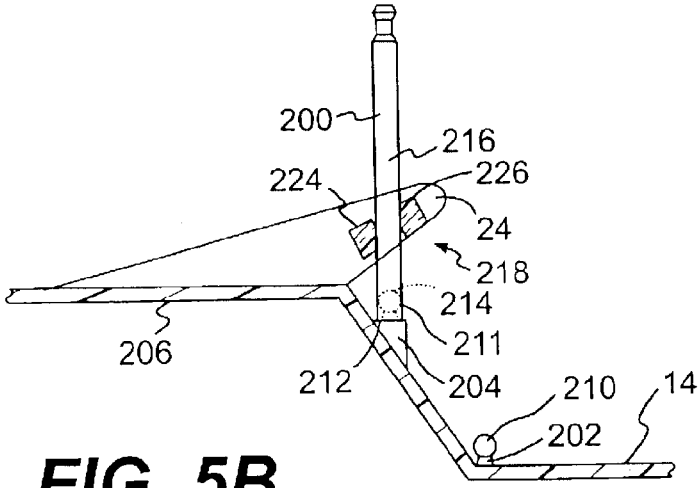
FIG. 5B is a partial cross-section of the deck and reboarding platform of one type of watercraft with a towing assembly in accordance with a third preferred embodiment of the invention in the operative position.

Another towing assembly in accordance with this invention provides a mounting arrangement for a pylon that allows the pylon to be stowed when not in use for towing. In this case a towing pole or rigid pylon 200 is provided with two mounting positions thus forming a variable attachment point. Referring to FIGS. 5A and 5B, a first mount 202 and a second mount 204 are provided on the deck 14 behind the pedestal 206. The mounts 202 and 204 are preferably spaced from each other along the longitudinal axis 208 and are displaced vertically with respect to a horizontal reference line. Preferably the mounts 202 and 204 are formed as balls 210, 211. However, the mounts 202 and 204 can take any form, including but not limited to posts and sockets.

The pylon 200 is supported at its bottom 212 by one of the mounts 202 and 204. The bottom 212 of the pylon 200 has a receiving formation, which is preferably a socket 214 for selectively receiving the balls 210, 211. However, the bottom 212 can take any form that will allow the mounts 202 and 204 to support the pylon 200 substantially without vertical or horizontal movement. A locking mechanism, such as a pin or snap fit, could also be added if desired to form a locked secure mounting connection.

The pylon 200 is supported along its shaft 216 by a lateral support member 218. The lateral support member 218 is preferably formed by the grab handle 24 such that the pylon 200 extends through an opening in the grab handle 24 in both the stowed position and the operative position. The lateral support member 218 provides two support channels 220, 222, which are preferably formed by two guide members 224, 226. Guide member 224 has a substantially vertical surface 228 and an angled surface 230, which extends forward at an acute angle to a vertical reference line. Guide member 226 has a substantially vertical surface 232 and an angled surface 234 that extends rearwardly at an acute angle to a vertical reference line.

Figure 6A:
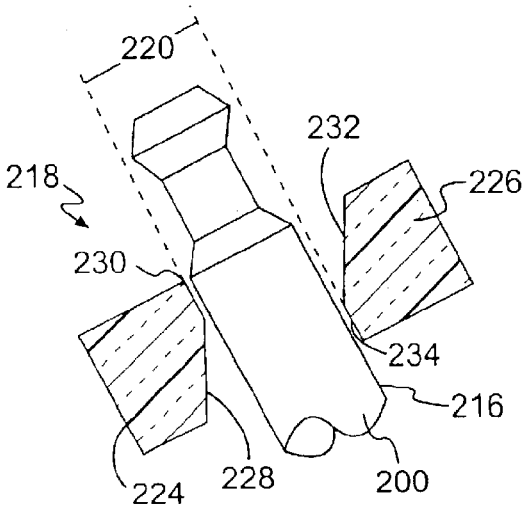
FIG. 6A is an enlarged partial cross-sectional view of the apparatus in FIG. 5A showing the pylon resting in the support channel in the stowed position.
Figure 6B:
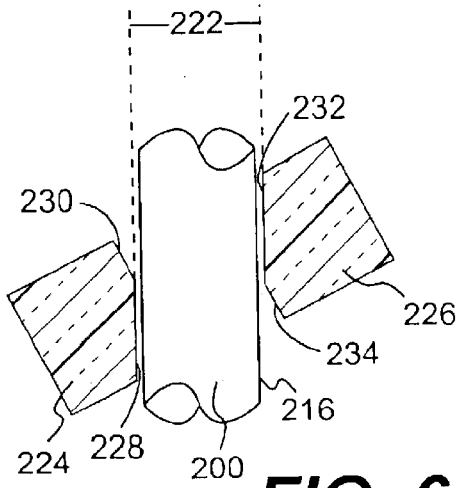
FIG. 6B is an enlarged partial cross-sectional view of the apparatus in FIG. 5B showing the pylon resting in the support channel in the operative position.
Figure 8:
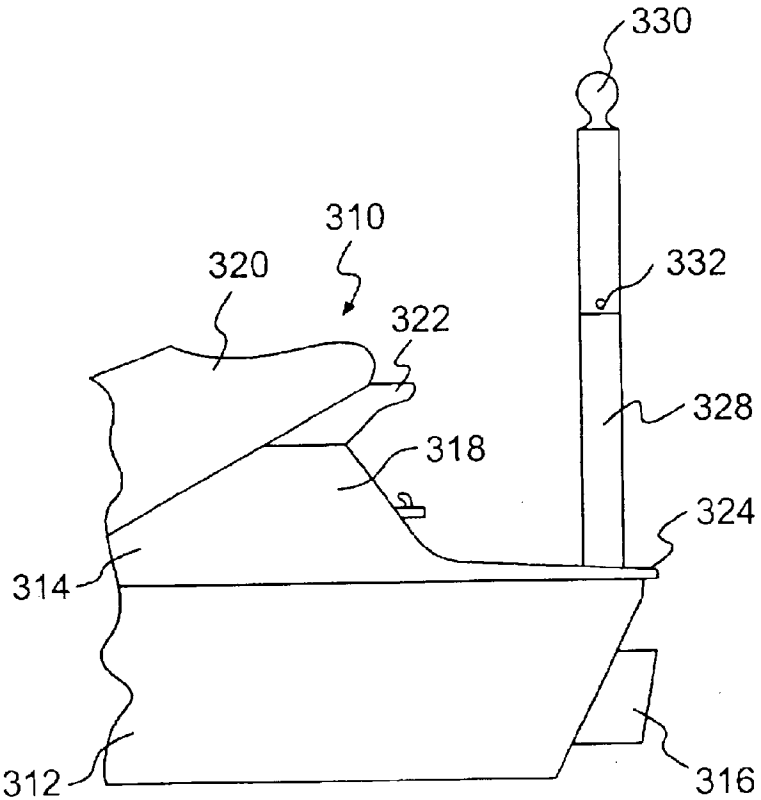
FIG. 8 PRIOR ART
FIG. 8 is a partial side view of a watercraft using a prior art towing apparatus with a telescoping pylon.
Figure 7:
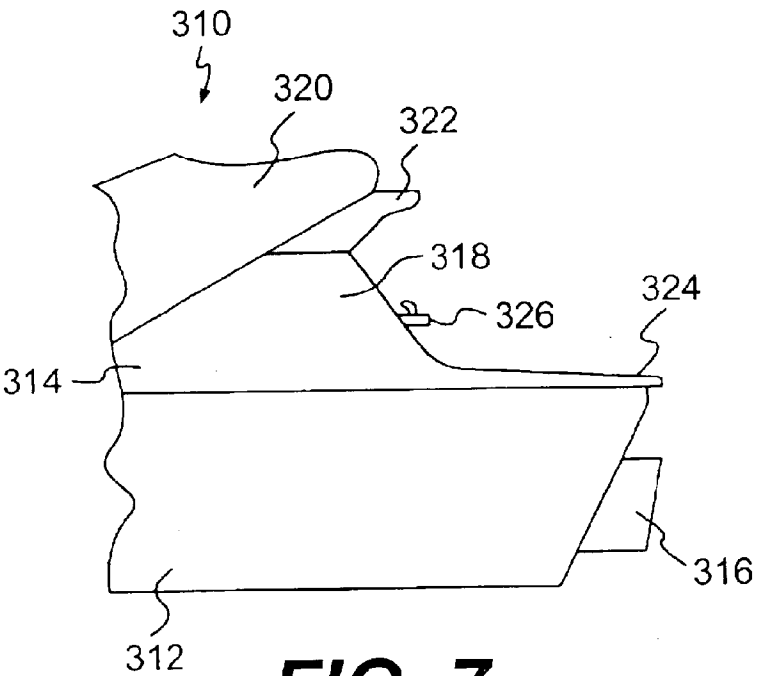
FIG. 7 PRIOR ART
FIG. 7 is a partial side view of a watercraft using a prior art towing apparatus with an eye hook.

The lateral support member 218 and variable attachment points provide two positions in which the pylon 200 may be placed: a stowed position and an operative position. When the pylon 200 is in the stowed position, the bottom 212 is supported by the first mount 202, and the shaft 216 is supported by the support channel 220 formed by the angled surfaces 230 and 234 of the guide members 224, 226. This position is illustrated in FIGS. 5A and 6A. When the pylon 200 is in the operative position, the bottom 212 is supported by the second mount 204, and the shaft 216 is supported by the support channel 224 formed by vertical inner surfaces 228, 232 of the guide members 224, 226. This position is illustrated in FIGS. 5B and 6B. Thus, it can be appreciated that the pylon 200 is securely stored in both positions and is conveniently inobtrusive in the stored position. It is also possible to use this arrangement with different types of pylons, including telescoping pylons, and other types of towing poles. By forming the lateral support 218 in the grab handle 24 extra parts are not necessary, which reduces costs and enhances the appearance of the vehicle.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A watercraft comprising:

a hull having a longitudinal center line and a deck supported by the hull;

a propulsion source supported by the hull; and a towing apparatus secured to at least one of the deck and the hull, the towing apparatus has a towing point from which a tow line extends and the towing point is movable with respect to the longitudinal center line, the towing apparatus comprising a curved towing bar having a non constant radius, two ends and an apex, with each end secured to at least one of the deck and the hull on apposed sides of the longitudinal center line and the apex being positioned rearwardly of the two ends with respect to the hull and generally aligned with the longitudinal center line.

2. The watercraft of claim 1, wherein the towing bar has a generally V-shaped.

3. The watercraft of claim 1, further comprising a tow line connector sildably supported on the towing path.

4. The watercraft of claim 3, wherein the tow line connector is a sliding sleeve that slides along an arcuate path.

5. The watercraft of claim 1, wherein the towing bar is formed from a bent tube.

6. The watercraft of claim 1, further comprising a pair of braces connected to the towing bar and one of the deck and the hull, each brace being positioned near one of the towing bar ends.

7. The watercraft of claim 1, wherein the towing bar apex forms the highest point with respect to the deck and the most rearward point with respect to the deck of the towing apparatus.

8. The watercraft of claim 1, wherein the towing apparatus is secured to the deck.

9. A watercraft comprising:

a hull having a longitudinal center line and a deck supported by the hull;

a propulsion source supported by the hull; and a towing apparatus formed as a flexible upright member extending upwardly from at least one of the deck and the hull, the towing apparatus having a towing point from which a tow line may extend, flexing of the upright member moving the towing point in space.

10. The watercraft of claim 9, wherein the upright member is generally wedge shaped having a wider and less flexible portion adjacent the deck.

11. The watercraft of claim 10, wherein the upright member has plurality of tow rope connectors disposed along its length.

12. The watercraft of claim 11, wherein the tow rope connectors are apertures that a tow rope can be looped through.

13. The watercraft of claim 9, wherein the upright member is more flexible at a top portion and less flexible at a bottom portion adjacent to the deck.

14. The watercraft of claim 9, wherein the flexible towing bar has a plurality of tow rope connecting portions.

15. The watercraft of claim 1, further comprising a straddle seat.

16. The watercraft of claim 15, wherein the towing apparatus is secured to the deck on either side of the straddle seat.

17. The watercraft of claim 1, wherein the propulsion source comprises an engine and a jet propulsion unit coupled to the engine.

18. The watercraft of claim 1, wherein the propulsion source comprises an outboard engine.

19. The watercraft of claim 1, wherein the watercraft is a personal watercraft.

20. The watercraft of claim 1, wherein the watercraft is a sport boat.

21. A watercraft comprising:

a hull and a deck supported by the hull;

a propulsion source supported by the hull;

a pylon support assembly positioned on the deck including a variable pylon attachment point; and a towing pylon removable secured to the variable attachment point in a first stowed position and in a second operative position, the pylon support assembly comprising a first mount located at a first position on the deck and the second mount located at a second position on the deck, the second position being higher with respect to a horizontal reference line than the first position, the first mount and the second mount forming the variable attachment point.

22. The watercraft of claim 21, wherein at least the second mount is a ball and the pylon has a socket that receives the ball.

23. The watercraft of claim 21, wherein the pylon support assembly further comprises a lateral support member having two support channels, a first support channel aligned with the first mount that receives the pylon in the first stowed position and a second support channel aligned with the second mount that receives the pylon in the second operative position.

24. The watercraft of claim 23, wherein the first support channel is disposed at an angle to the second support channel.

25. The watercraft of claim 23, wherein the lateral support member is a grab handle.

26. The watercraft of claim 21, further comprising a straddle seat.

27. The watercraft of claim 26, further comprising a grab handle having an opening therein and being disposed adjacent to the straddle seat wherein the towing pylon extends through the opening in the grab handle in the first stowed position end in the second operative position.

28. The watercraft of claim 21, wherein the propulsion source includes a jet propulsion unit.

29. The watercraft of claim 27, wherein the pylon has a first end and a second end, the first end being higher than the second end and being generally flush with an upper surface of the grab handle when the towing pylon is in the first stowed position.

* * * * *